US008841865B2

(12) United States Patent
Kim et al.

(10) Patent No.: US 8,841,865 B2
(45) Date of Patent: Sep. 23, 2014

(54) LIGHTING SYSTEM AND METHOD FOR CONTROLLING THE SAME

(75) Inventors: Changho Kim, Seoul (KR); Taegi Kim, Seoul (KR); Geunchang Do, Seoul (KR)

(73) Assignee: LG Electronics Inc., Seoul (KR)

( * ) Notice: Subject to any disclaimer, the term of this patent is extended or adjusted under 35 U.S.C. 154(b) by 135 days.

(21) Appl. No.: 13/292,538

(22) Filed: Nov. 9, 2011

(65) Prior Publication Data

US 2012/0242254 A1 Sep. 27, 2012

(30) Foreign Application Priority Data

Mar. 21, 2011 (KR) ..... 10-2011-0024912

(51) Int. Cl.
*H05B 37/00* (2006.01)

(52) U.S. Cl.
USPC ..... 315/312; 315/292; 315/319

(58) Field of Classification Search
USPC ..... 315/291–292, 307, 312–319
See application file for complete search history.

(56) References Cited

U.S. PATENT DOCUMENTS

| | | | | |
|---|---|---|---|---|
| 5,533,186 | A * | 7/1996 | Tanahashi et al. | 345/549 |
| 7,167,777 | B2 * | 1/2007 | Budike, Jr. | 700/297 |
| 7,307,542 | B1 * | 12/2007 | Chandler et al. | 340/9.16 |
| 7,972,028 | B2 * | 7/2011 | Durand et al. | 362/231 |
| 8,214,061 | B2 * | 7/2012 | Westrick et al. | 700/9 |
| 8,270,767 | B2 * | 9/2012 | Park | 382/284 |
| 8,296,669 | B2 * | 10/2012 | Madonna et al. | 715/765 |
| 8,368,325 | B2 * | 2/2013 | Kim et al. | 315/312 |
| 2003/0156136 | A1 * | 8/2003 | Cattell et al. | 345/771 |
| 2005/0248651 | A1 * | 11/2005 | Hirata et al. | 348/14.08 |
| 2005/0275626 | A1 * | 12/2005 | Mueller et al. | 345/156 |
| 2006/0290710 | A1 * | 12/2006 | Zwanenburg | 345/594 |
| 2011/0043116 | A1 * | 2/2011 | Schenk et al. | 315/152 |
| 2011/0084614 | A1 * | 4/2011 | Eisele et al. | 315/152 |
| 2011/0134252 | A1 * | 6/2011 | Furukawa | 348/177 |
| 2012/0281879 | A1 * | 11/2012 | Vlutters et al. | 382/103 |

FOREIGN PATENT DOCUMENTS

| | | | |
|---|---|---|---|
| KR | 10-2005-0042742 | A | 5/2005 |
| KR | 10-2008-0061631 | A | 7/2008 |
| KR | 10-2009-0088952 | A | 8/2009 |
| KR | 10-2009-0129136 | A | 12/2009 |
| KR | 10-2010-0009512 | A | 1/2010 |
| KR | 10-2010-0022071 | A | 2/2010 |
| WO | WO 2009/111606 | A2 | 9/2009 |
| WO | WO 2010/070517 | A1 | 6/2010 |
| WO | WO 2010/141076 | A1 | 12/2010 |

OTHER PUBLICATIONS

European Search Report dated Jul. 25, 2012.

(Continued)

*Primary Examiner* — Jason M Crawford
(74) *Attorney, Agent, or Firm* — Ked & Associates, LLP

(57) ABSTRACT

A lighting control system as disclosed herein may include a plurality of lighting apparatuses provided in a building, a display for displaying an image representing the plurality of lighting apparatuses, an input interface for selecting at least one region on the image that corresponds to one or more of the plurality of lighting apparatuses, a memory for storing the defined region of the image, and a controller configured to control the lighting apparatuses. One or more control groups may be configured based on the selected region and the image may be updated to display the control groups.

20 Claims, 16 Drawing Sheets

(56) References Cited

OTHER PUBLICATIONS

Korean Office Action dated Apr. 18, 2011 issued in Application No. 10-2011-0024912 (English translation attached).
Korean Office Action dated Jun. 8, 2011 issued in Application No. 10-2011-0024912 (English translation attached).
Korean Office Action dated Aug. 17, 2011 issued in Application No. 10-2011-0024912 (English translation attached).
Korean Notice of Allowance dated Sep. 16, 2011 issued in Application No. 10-2011-0024912 (English translation attached).

* cited by examiner

LIGHTING SYSTEM AND METHOD FOR CONTROLLING THE SAME

CROSS-REFERENCE TO RELATED APPLICATION(S)

This application claims priority under 35 U.S.C. §119 to Korean Application No. 10-2011-0024912 filed in Korea on Mar. 21, 2011, whose entire disclosure(s) is/are hereby incorporated by reference.

BACKGROUND

1. Field

A lighting system and a method for controlling the same are disclosed herein. The lighting system includes a central controller which allows control of the lighting system through a graphical user interface (GUI). The lighting system and method of the present disclosure allows a more efficient utilization and conservation of energy resources.

2. Background

Lighting systems and methods for controlling the same are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

Figure 1:
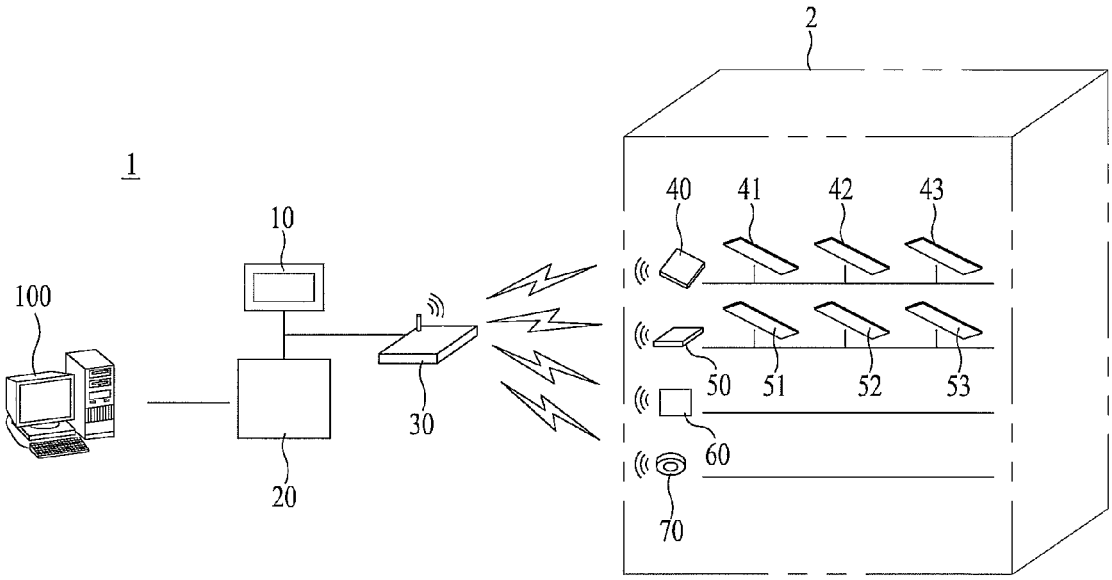
FIG. 1 illustrates a schematic view of a lighting system in accordance with an embodiment of the present disclosure.

In general, incandescent lamps, discharge lamps, and fluorescent lamps are used most commonly as light sources for various purposes, such as domestic, landscape, industrial, or other appropriate types of lighting applications. These types of light sources suffer from various disadvantages such as poor efficiency and large amounts of heat generation (e.g., incandescent lamps), high price and high operational voltage (e.g., discharge lamps), and may be harmful to the environment due to their use of mercury (e.g., fluorescent lamps).

Light emitting diode (LED) based light sources may overcome the drawbacks of these light sources. LEDs have advantages in efficiency, flexibility to emit light in a variety of colors, autonomy of design, and so on. The LED is a semiconductor device which emits light when a forward voltage is applied thereto. LEDs have a greater lifespan, lower power consumption, and electric, optical, and physical characteristics which are suitable for mass production when compared to incandescent, discharge, or fluorescent types of light sources.

A controller may be provided to control the light sources. For example, a large building may be equipped with a lighting system that includes a large number of LED based light sources. The controller may be a central controller configured to manage and control the lighting system. The controller may control the operation of the LEDs, for example, to turn on/off the LEDs, and manage the operational states, for example, to manage power consumption or collect state information of the light sources. The controller may manage and control the lighting based on a particular zone or group of light sources (e.g., a floor or room). The controller may detect areas in which unnecessary energy is being consumed to minimize waste. The controller may manage maintenance of equipment (e.g., maintenance schedules, fault detection, etc.) as well as maintenance of an inside environment of the building (e.g., operation based on schedules, occupancy, etc.) to control energy consumption.

One or more interfaces may be provided on each floor or zone in the building and connected in communication with the central controller. The interface may be configured to receive control inputs as well as to display operational states of the lighting apparatuses. The interface may include a GUI to control and manage the lighting system.

The GUI may display an image of the building or one or more zones in the building to enable a user to graphically control the lighting system. The GUI may be a plan view image of a lighting space or zone (e.g., a floor in building) including graphical representations of one or more control groups of light emitting apparatuses. The lighting system may allow for savings in time and expense in controlling the lighting system, for example, to configure a zone or control group within a lighting space. The lighting system as disclosed herein allows a more efficient utilization and conservation of energy resources.

Figure 2:
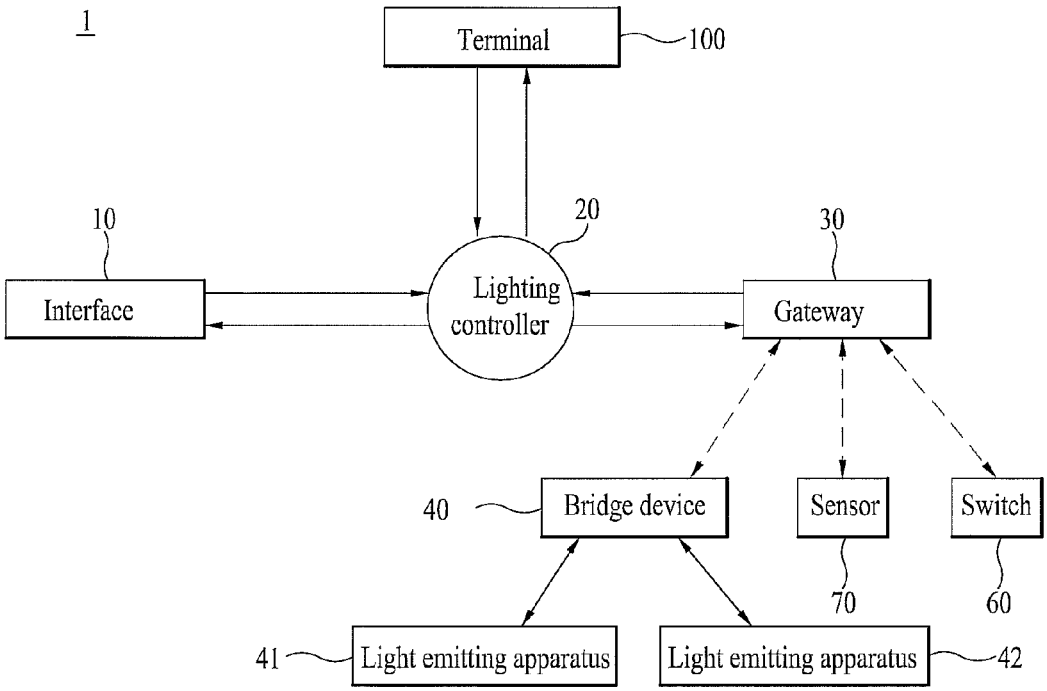
FIG. 2 illustrates a block diagram of a lighting system in accordance with an embodiment of the present disclosure.
Figure 3:
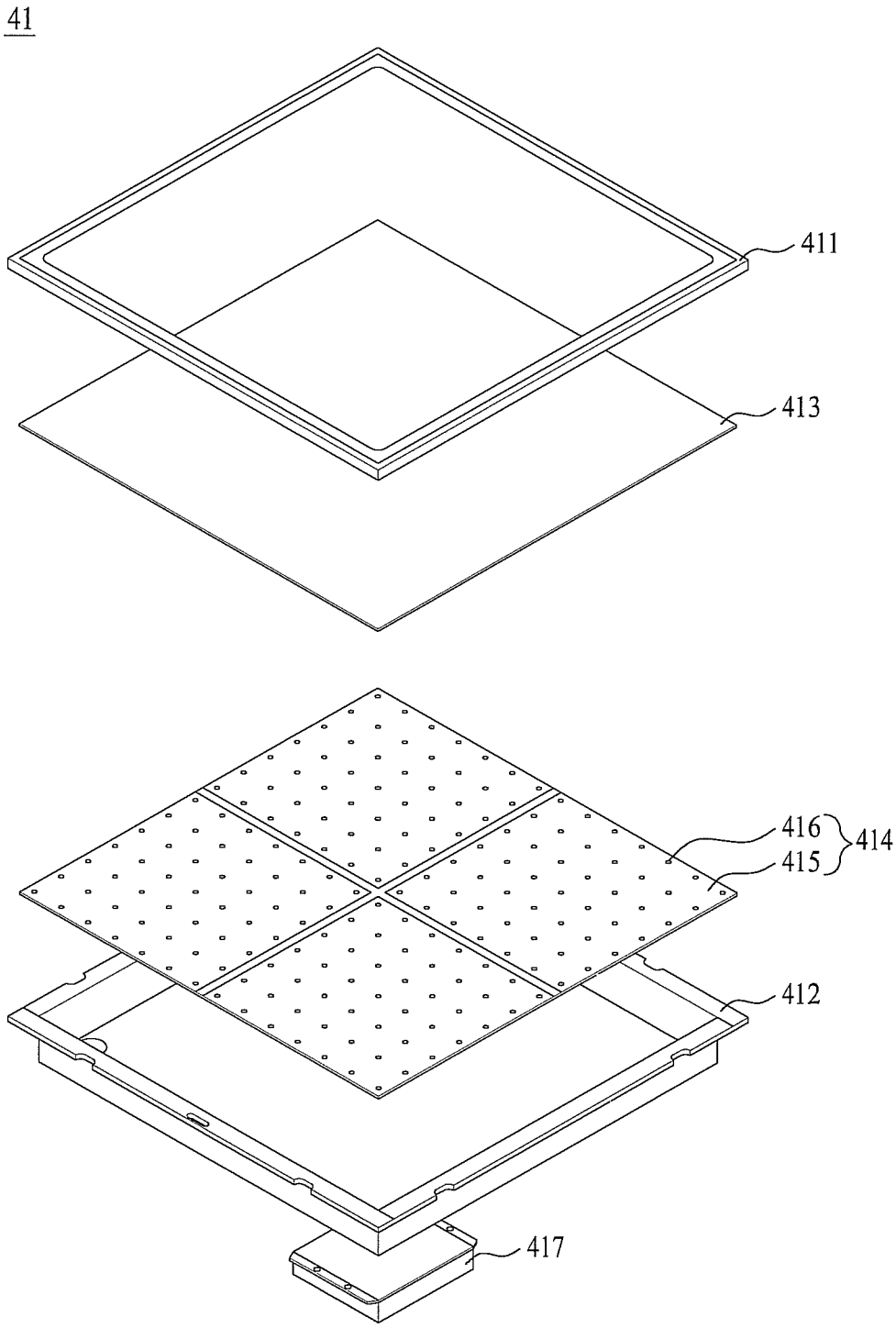
FIG. 3 illustrates an exploded perspective view of a light emitting apparatus of a lighting system in accordance with an embodiment of the present disclosure.

FIG. 1 illustrates a schematic view of a lighting system and FIG. 2 illustrates a block diagram of the lighting system in accordance with an embodiment of the present disclosure. FIG. 3 illustrates an exploded perspective view of a light emitting apparatus of a lighting system in accordance with an embodiment of the present disclosure.

The lighting system 1 may include an interface 10, a lighting controller 20, a terminal 100, a gateway 30, bridge devices 40, 50, a plurality of light emitting apparatus 41-43, 51-53 connected to the bridge devices 40, 50 to enable communication therebetween, a switch 60, and a sensor 70. It should be appreciated that the lighting system 1 may include various combinations of the elements which are shown in FIG. 1.

A building 2 may have installed therein the plurality of light emitting apparatuses 41-43, 51-53, the switch 60 to turn the light emitting apparatuses on/off, and the sensor 70 to sense light intensity, or the like, in a lighting space. The light emitting apparatuses 41-43, 51-53 may be one of a plurality of types of light sources including, for example, an LED type light source. The light emitting apparatus 41-43 and 51-53 provided in the building 2 may be a flat type or a bulb type light source.

Referring to FIG. 3, the light emitting apparatus 41 may include a front case 411, a rear case 412, a light emitting module 414 disposed in a space between the front case 411 and the rear case 412, a diffusing member 413 disposed between the light emitting module 414 and the front case 411, and a converter 417 electrically connected to the light emitting module 414. The light emitting module 414 may include a substrate 415 and a plurality of LEDs 416 mounted to the substrate. The light emitting apparatus 41 may be a flush mount type lighting device in which the converter 417 and a region of the rear case 412 are mounted inside a wall or another appropriate type of surface. The LEDs 416 may have a color rendition which is higher than Ra 75, and an efficiency which is higher than 65 lm/W.

Referring again to FIGS. 1 and 2, the lighting controller 20 may be provided to control the operation of the light emitting apparatuses 41-43, 51-53 based on received inputs. The lighting controller 20 may be connected to the terminal 100, the interface 10, and the gateway 30. The lighting controller 20 may receive various control inputs for controlling the light emitting apparatuses 41-43, 51-53 from the terminal 100 or interface 10 and transmit appropriate control signals to the gateway 30 to control the lighting. The lighting controller 20 may receive monitoring information from the sensor 70. The lighting controller 20 may directly control the light emitting apparatuses based on the received monitoring information and/or forward the monitoring information to the terminal 100 and interface 10.

Moreover, the lighting controller 20 may store addresses of each light emitting apparatus as well as the switch 60 and sensor 70. The lighting controller 20 may also store user preference information, scheduling information, zone or control group information, or another appropriate type of information to control and manage the lighting system 1.

The gateway 30 may communicate with the lighting controller 20 to receive control signals from the lighting controller 20 for group/individual lighting control or entire floor or building control. The gateway 30 may forward the control signals to an appropriate device to control the same. The gateway 30 may communicate with the lighting controller 20, the bridge devices 40, 50, the switch 60, or sensor 70 over a wireless or wired connection. In one embodiment, the gateway 30 may be a Zigbee gateway.

The bridge devices 40, 50 may be connected to the gateway 30 and the plurality of the light emitting apparatuses 41-43, 51-53 to enable communication therewith for transmitting the control signals from the gateway 30 to the light emitting apparatuses 41-43 and 51-53. The bridge devices 40, 50 may also transmit a response or event information from the light emitting apparatuses 41-43, 51-53 to the gateway 30.

The first bridge device 40 may be connected to a first group of light emitting apparatuses 41-43 and the second bridge device 50 may be connected to a second group of light emitting apparatuses 51-53 to enable communication therewith. The bridge devices 40, 50 may be connected up to a prescribed maximum number of light emitting apparatuses. In one embodiment, the bridge device 40, 50 may be connected up to 12 light emitting apparatuses.

As an example, the bridge devices 40, 50 may be connected to the gateway 30 using the Zigbee specification. The bridge devices 40, 50 may be connected to the light emitting apparatuses 41-43, 51-53 using the RS-485 protocol which is a serial communication protocol.

An input received, for example, at the interface 10 may be transmitted to the lighting controller 20, the gateway 30, and the bridge device 40, 50 in succession. The bridge device 40 may transmit the received commands to the appropriate light emitting apparatus through the serially connected light emitting apparatuses 41-43. Likewise, bridge device 50 may forward the commands to an appropriate light emitting apparatus serially connected thereto. For example, a command to turn off light emitting apparatus 42 may be serially transmitted through light emitting apparatus 41.

A response or state/event information related to the light emitting apparatuses 41-43, 51-53 may be transmitted to a corresponding bridge device, the gateway 30, the lighting controller 20, and the interface 10, in succession. For example, a response or state/event information from light emitting apparatus 42 may be transmitted to light emitting apparatus 41 and then to bridge 40 over the RS-485 protocol. The response or state/event information may then be forwarded to gateway 30 using Zigbee.

The terminal 100 may be connected to the lighting controller 20 to control the light emitting apparatuses 41-43, 51-53. The terminal 100 may manage state information and power consumption in real-time, including turning the light emitting apparatuses on/off or changing the light intensity of the light emitting apparatuses mounted in a particular zone. The terminal 100 may also detect areas which may be using unnecessary energy to minimize waste, manage equipment in the building, manage maintenance of equipment operation, manage maintenance of an inside environment of the building, manage energy and materials consumed through the above management operations, or the like.

The terminal 100 and the lighting controller 20 may be installed separately or the lighting controller 20 may be integrated into the terminal 100. For example, the terminal 100 may be installed in a main equipment room or at a remote location outside the building 2 and the lighting controller 20 may be mounted on each floor of the building 2. Alternatively, the terminal 100 and the lighting controller 20 may be integrated and installed as a single apparatus.

The terminal 100 may be a desktop computer, laptop, display panel, PDA, tablet, or another appropriate type of device capable of performing the management functions. The terminal 100 may be connected over a distributed network through an appropriate type of network protocol (e.g., TCP/IP). The terminal 100 may be connected via wired or wireless connections.

In certain embodiments, a plurality of terminals 100 may be provided such that each terminal 100 may perform the management functions to control the lighting system 1. In this case, the plurality of terminals 100 may communicate with each other to synchronize information related to the management of the lighting system 1 such as operating schedules, or the like.

The interface 10 may be a display panel for inputting control inputs or displaying state information of the lighting system. The interface 10 may have a form factor which is smaller in size when compared to the terminal 100 which may allow the interface 10 to be easily installed throughout the building 2. For example, the interface 10 may have a size and shape suitable to be wall mounted or used as a mobile device. An interface 10 may be provided on each floor or zone in the building 2 to receive control inputs and to display a GUI for controlling and monitoring the light emitting apparatuses 41-43, 51-53 in the lighting system 1.

The display of the interface 10 may be a touch screen display. The interface 10 may communicate with the lighting controller 20, may transmit inputs received through the GUI to the lighting controller 20 to control various groups/zones of lighting apparatuses. For example, the interface 10 may transmit control information to the lighting controller 20 to control a group/individual lighting apparatuses or an entire story or building. The interface 10 may also receive status information, or the like, from the lighting controller 20. The interface 10 may display the received information on the GUI.

It should be appreciated that while the interface 10 is described hereinabove as a display panel, the present disclosure is not limited thereto. The interface 10 may also be a desktop terminal (e.g., a desktop computer), laptop, PDA, tablet, or another appropriate type of computing device. Moreover, while the terminal 100 and the interface 10 have been disclosed as being connected through the lighting controller 20, it should be appreciated that the terminal 100 and interface 10 may be connected such that signals do not necessarily traverse through the lighting controller 20. For example, the terminal 100 and the interface 10 may be directly connected to each other or connected in a distributed network configuration with the lighting controller 20.

Figure 4:
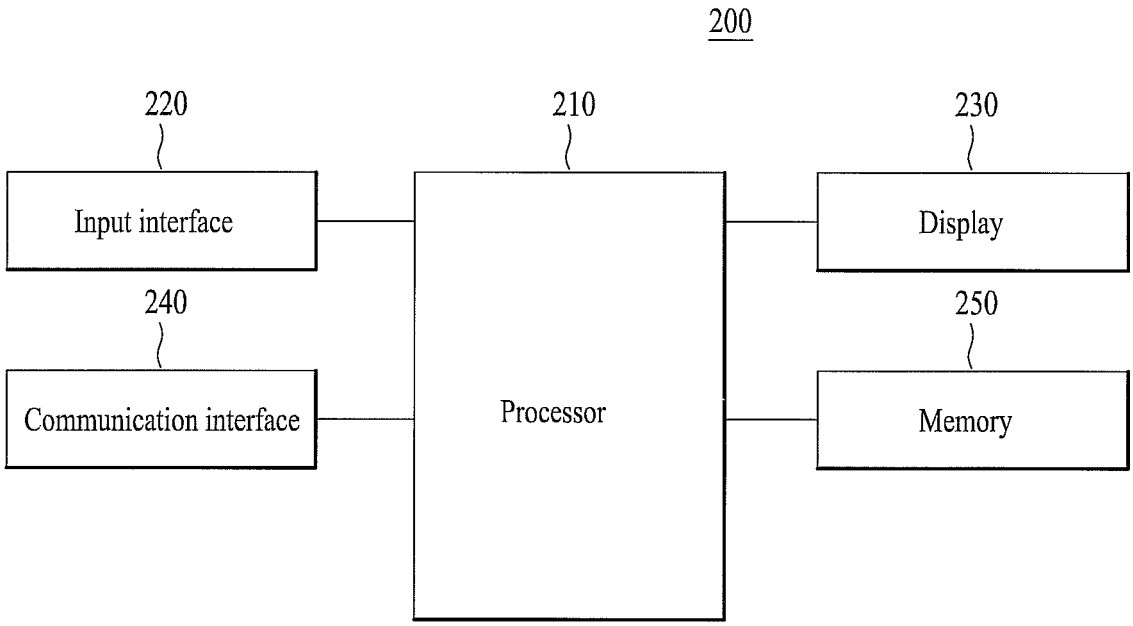
FIG. 4 illustrates a block diagram of a central controller in accordance with an embodiment of the present disclosure.

FIG. 4 illustrates a block diagram of a central controller in accordance with an embodiment of the present disclosure. One or more of the terminal 100 or the interface 10 may be designated as the central controller 200 to control and manage the lighting system 1.

The central controller 200 may include a processor 210, an input interface 220 for receiving a control input, a display 230 for displaying drawing information corresponding to a lighting space having the plurality of light emitting apparatuses 41-43, 51-53 mounted thereto, a communication interface 240 for enabling communication with other elements in the lighting system 1, a memory 250, and a processor 210. The central controller 200 may communicate with the lighting controller 20 through the communication interface 240 over SOAP, BACnet, or another appropriate type of a communication protocol.

The central controller 200 may store user settings for the lighting system in memory 250. The central controller 200 may transmit the user settings information to the lighting controller 20. The central controller 200 may store and maintain schedule information for controlling the lighting system and transmit control information to the lighting controller 20 to control the light emitting apparatuses 41-43, 51-53 according to the stored schedule. The central controller 200 may forward the schedule information to the lighting controller 20 for storage thereon. Moreover, the central controller 200 may retrieve user settings, schedule, or the like, stored in the lighting controller 20 by requesting the same from the lighting controller 20. The central controller 200 may monitor a state of the lighting system 1 by receiving monitoring information from the lighting controller 20.

The display 230 may display a GUI for controlling and monitoring the lighting system 1. The central controller 200 may transmit inputs received through the GUI to the lighting controller 20. The central controller 200 may control an individual light emitting apparatus or a group of light emitting apparatuses based on a control group. For example, the lighting on an entire floor or building may be controlled. The central controller 200 may also receive status information, or the like, from the lighting controller 20 and may display the received information on the GUI. The display 230 may be a touch screen display configured to receive control inputs. For example, an interface 10 having a touch screen display may be configured as the central controller 200. In this case, the touch screen display of the interface 10 may correspond to the display 230 and/or the input interface 220.

The GUI of the present disclosure may allow control and monitoring of individual or a group of lighting apparatuses. The GUI may include a plan view image of a particular lighting space, including one or more control groups. Through the GUI, the light emitting apparatuses in a particular control group may be controlled together.

The GUI in the central controller 200 may be used to configure the control groups. For example, the GUI of the central controller 200 may provide an interface to create, delete, divide, or merge one or more control groups.

A terminal 100 or interface 10 may be designated to operate as the central controller 200. In one embodiment, a terminal 100 or interface 10 may be designated as the central controller 200 based on a user profile. For example, a user may log in to a terminal 100 or interface 10 using a prescribed user account. According to the access permissions associated with the user account, the terminal 100 or interface 10 may operate as the central controller 200, for example, to configure control groups.

Figure 5A:
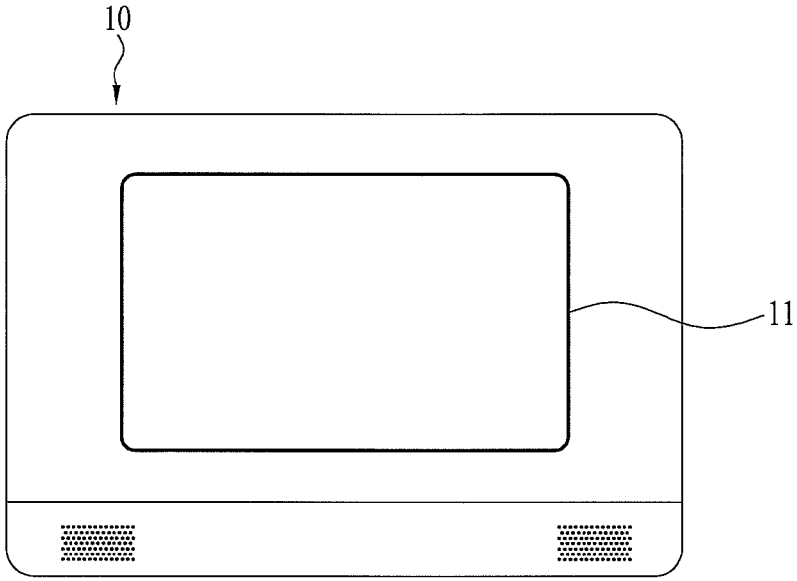
FIGS. 5A and 5B show an interface and an image displayed on the interface in accordance with an embodiment of the present disclosure.
Figure 5B:
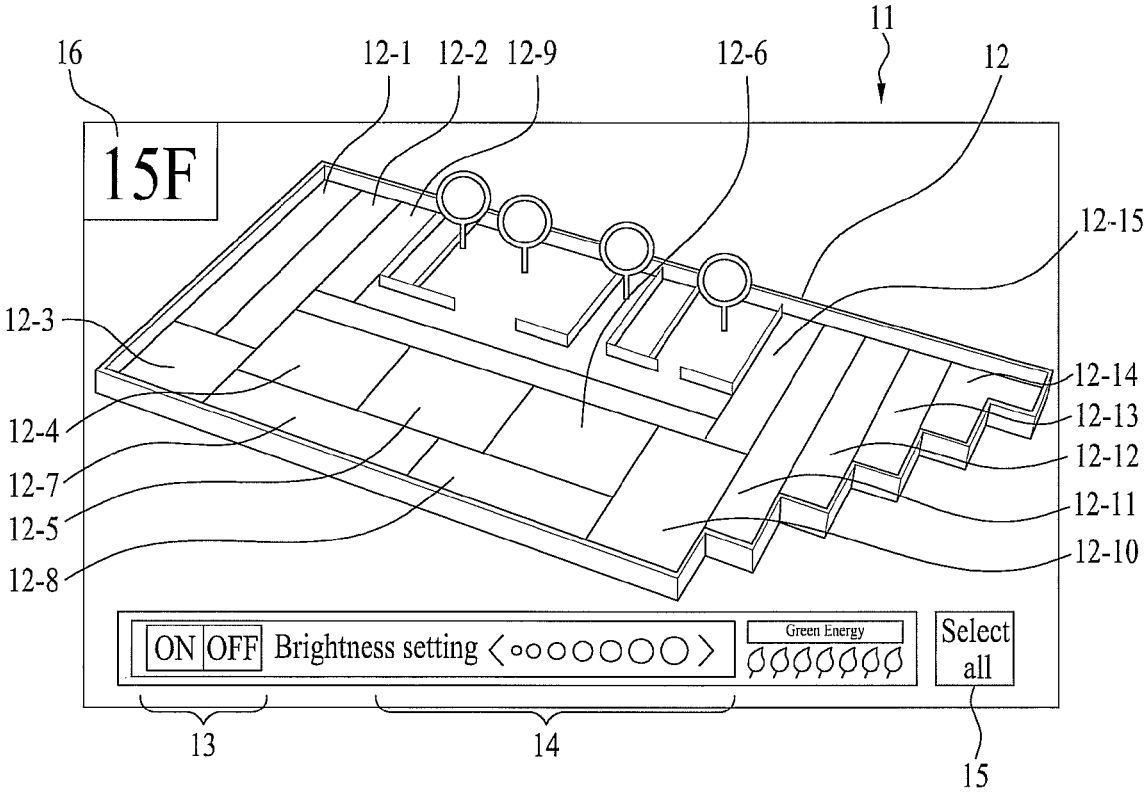

FIGS. 5A and 5B show an interface 10 and an image of a lighting space displayed on the interface in accordance with an embodiment of the present disclosure. The interface 10 may include a display 11 for displaying state information and regional information associated with the light emitting apparatuses. The display 11 may display drawing information, such as a plan view image 12 of a lighting space, to provide a GUI for controlling and monitoring the lighting system 1. The plan view image 12 may be divided into a plurality of control groups 12-1 to 12-15 for controlling the light emitting apparatuses mounted in a particular zone.

The display 11 may display a plurality of input objects for inputting commands to control the light emitting apparatuses. For example, the display 11 may include an input object 13 for turning on/off of the light emitting apparatuses, input object 14 for dimming the light emitting apparatuses, and input object 15 to toggle between a selection of an individual, group, or all of the light emitting apparatuses. The input objects may be selectable images of buttons, toggle switches, icons, menus, or the like. In certain embodiments, physical buttons (e.g., mechanical buttons) may be provided on the body of the interface 10 which may be configured to initiate a prescribed function when selected, similar to the displayed input objects.

The display 11 may display an object 16 to indicate the displayed building and/or floor number, for example. Moreover, the display 11 of the interface 10 may be a touch screen type display. A displayed lighting control group (e.g., 12-1) may be selected on the display 11 to control various functions of the lighting apparatuses in the selected control group, for example, to select, turn on/off, or change a brightness of the light emitting apparatuses.

Figure 6:
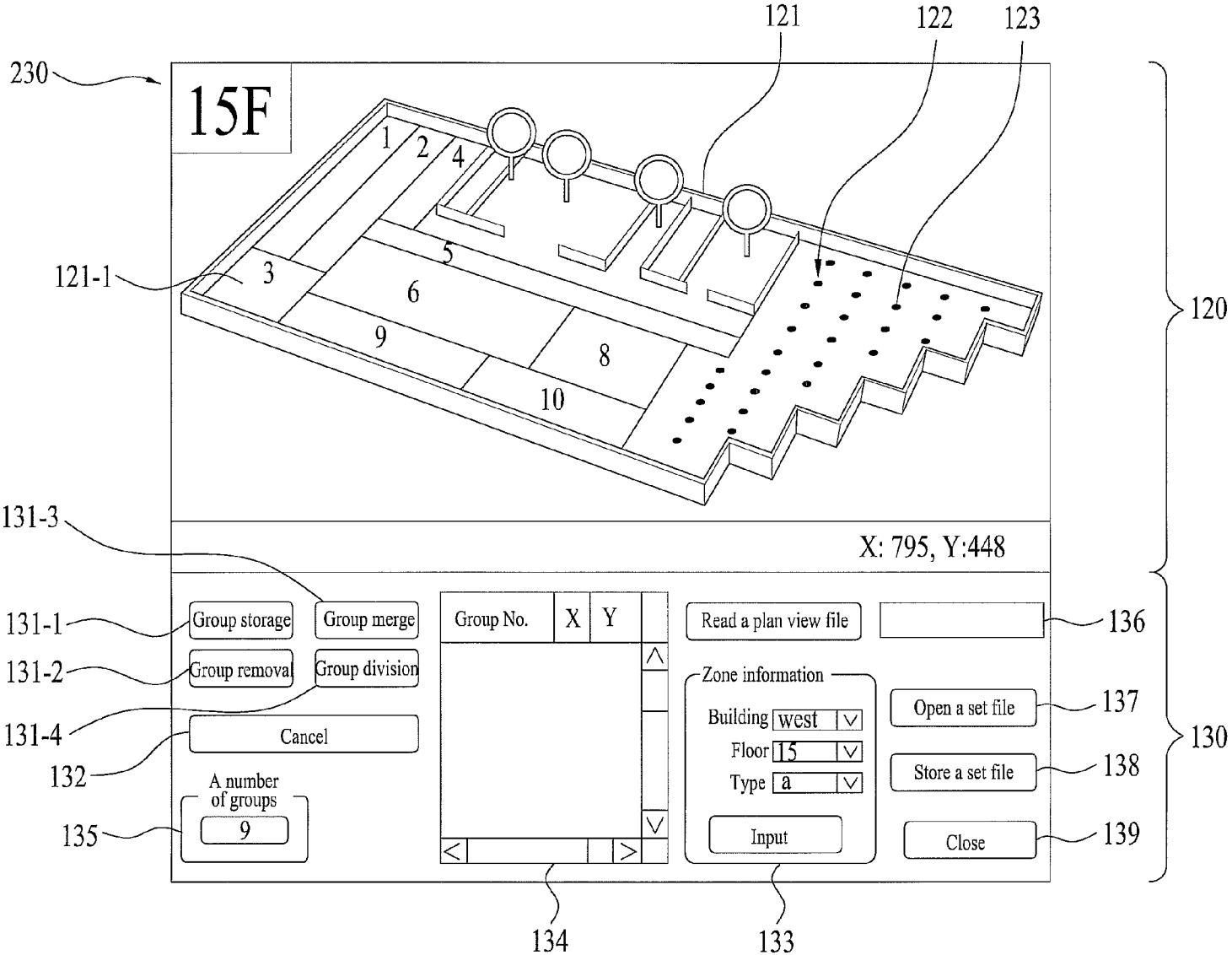
FIG. 6 shows an image displayed on a central controller in accordance with an embodiment of the present disclosure.

FIG. 6 illustrates a plan view of a display on a central controller in accordance with an embodiment of the present disclosure. The terminal 100 or interface 10 may be designated to be the central controller 200. The central controller 200 may include a display 230 for displaying an image 121 of a lighting space or zone having the plurality of light emitting apparatuses mounted thereto. A processor 210 may be provided for generating a reference coordinate system 122 for display on the image 121. The lighting space or zone may be divided into a plurality of control groups using the reference coordinate system 122.

The image 121 of the lighting space may be a plan view image of a floor plan or a particular zone. The reference coordinate system 122 provided in the image 121 may include a plurality of dots 123 spaced at predetermined intervals along a horizontal and vertical directions of a rectangular coordinate system. The plurality of dots 123 may represent reference coordinates in the reference coordinate system 122 on the displayed floor plan or zone. The processor 210 may activate, for example, a particular lighting space 121-1 defined by selecting corresponding dots 123 in the reference coordinate system 122 based on user input. It should be appreciated that the plurality of dots 123 may be an icon, lines, grid, crosshairs, or another appropriate type of mark or indicia to indicate a position in the reference coordinate system 122.

Each of the plurality of dots 123 of the reference coordinate system 122 may have one or more light emitting apparatuses 41-43, 51-53 associated thereto. Each light emitting apparatus 41-43, 51-53 may have a unique address which identifies the light emitting apparatus. Corresponding addresses of the light emitting apparatuses 41-43, 51-53 may be stored together with the control group information. For example, when a control group is defined through a selection of one or more dots 123, the addresses of light emitting apparatuses associated with the selected dots 123 may be stored together with the defined control group information. The control group information, including the address information, may be stored together with the image information.

The GUI including the image 121 and reference coordinate system 122 may be used to manage the control groups, for example, to create a new control group, delete an existing control group, divide an existing control group into two or more new control groups, or merge two or more control groups.

Once a region of the lighting space is defined by selecting a plurality of dots 123 displayed in the image 121, a corresponding button displayed on the display 230 may be selected to configure the control group within the displayed zone. The central controller 200 may integrate the newly configured control group(s) with existing control groups and store the same together with the image information.

The display 230 of the central controller 200 may include a first display region 120 that displays the image 121 of the lighting space and a second display region 130 that displays a plurality of input objects 131-139. The input objects 131-139 may be an icon, button, toggle switch, input field, pull down menu, list, or another appropriate graphical interface. The central controller 200 may also include a processor 210 that generates the reference coordinate system 122 for display in the first display region 120 of the display 230 for configuring the control groups. The reference coordinate system 122 may be used to add, delete, merge, divide as well as reconfigure an existing control group based on received inputs.

The second display region 130 may include, for example, an input object 131-1 for storing a control group, an input object 131-2 for removing a control group, an input object 131-3 for merging two or more control groups, and an input object 131-4 for dividing a control group into two or more control groups. Multiple control groups may be selected to apply the various operations. For example, multiple control groups may be selected to be deleted or divided at the same time. An input object 132 may be provided to cancel an operation. An input object 133 may be provided to select a particular zone or lighting space.

A prescribed region in the image 121 displayed in the first display region 120 may be selected to be active for applying various operations. The region may be selected by selecting the plurality of dots 123 of the reference coordinate system 122 or by selecting a preexisting control group. The reference coordinates 123 may be arranged at predetermined intervals and correspond to one or more of the light emitting apparatuses mounted in the building 2.

Once a particular region in the displayed lighting space is selected, the processor 210 may configure the lighting space based on selection of input objects 131-1 to 131-4. If Group storage button 131-1 is pressed, the selected region may be stored as a new control group. Here, if the selected region includes a preexisting control group, the original control group may be updated to reflect the newly selected region. If the Group removal button 131-2 is pressed, a preexisting control group in the selected region may be deleted. If the Group merge button 131-3 is selected, the control groups in the selected region may be merged to form a single control group. Moreover, if the Group division button 131-4 is selected, the control groups in the selected region may be divided into additional control groups.

The processor 210 may generate control group numbers for each of the control groups for display on the image 121 (e.g., control groups 1-6 and 8-10 as shown in FIG. 6). The control group number may facilitate identification and selection of existing control groups. As described further hereinafter, control groups may be selected using the control group numbers, for example, by inputting the number in a pop-up window. Moreover, the processor 210 may store the configuration of the lighting space together with the image information or update a preexisting configuration such that image 210 reflects the stored changes.

FIGS. 7A, 7B, 8A and 8B show plan views that illustrate an operation to create a new control group in accordance with an embodiment of the present disclosure. Upon selection of input object 136 ("Read a plan view file") in the second display region 130 of the display 230, a plan view file may be retrieved from the data base and the plan view image 121 of the lighting space may be displayed in the first display region 120. The input object 136 may include an input field for entering the name of the desired plan view file.

Input object 133 ("Zone information") may be provided to select a particular lighting space. Input object 133 may include drop down menus 133*a* for designating the building, floor, and type associated with the lighting space. The displayed plan view image 121 may correspond to the lighting space or zone selected using the input object 133*a*. The drop down menus 133*a* may also be used to set information associated with a new zone.

Input object 133 may include a button 133*a* ("Input"). Selection of button 133*a* may display X and Y coordinates of a cursor or icon displayed in the first display region 120. The cursor or icon may be moved using a mouse or touch screen, for example. The displayed coordinates are updated to reflect the movement of the cursor or icon in the plan view image 121.

Figure 7A:
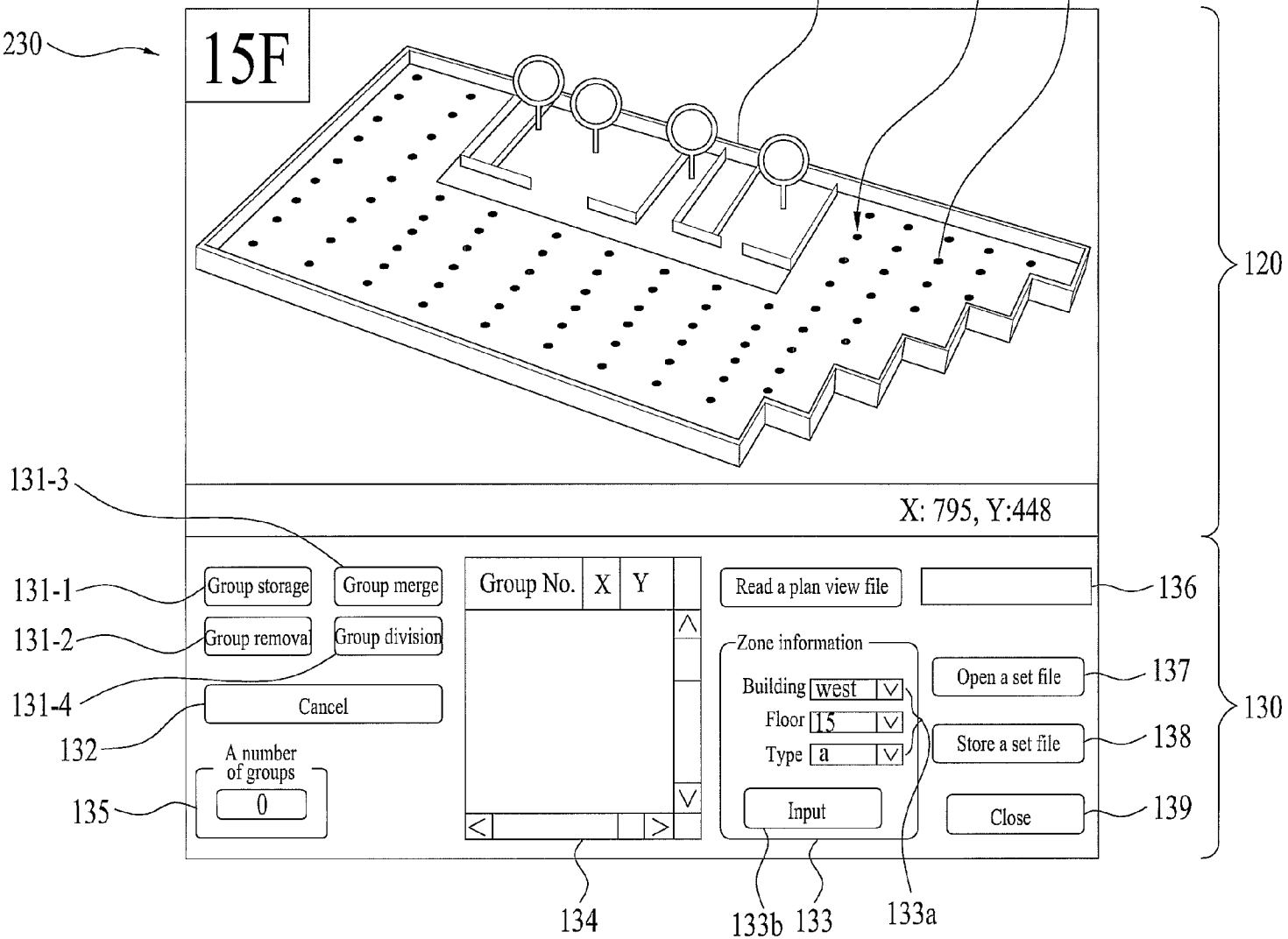
FIGS. 7A, 7B, 8A, and 8B show display images that illustrate an operation to set a control group in a lighting system in accordance with an embodiment of the present disclosure.
Figure 7B:
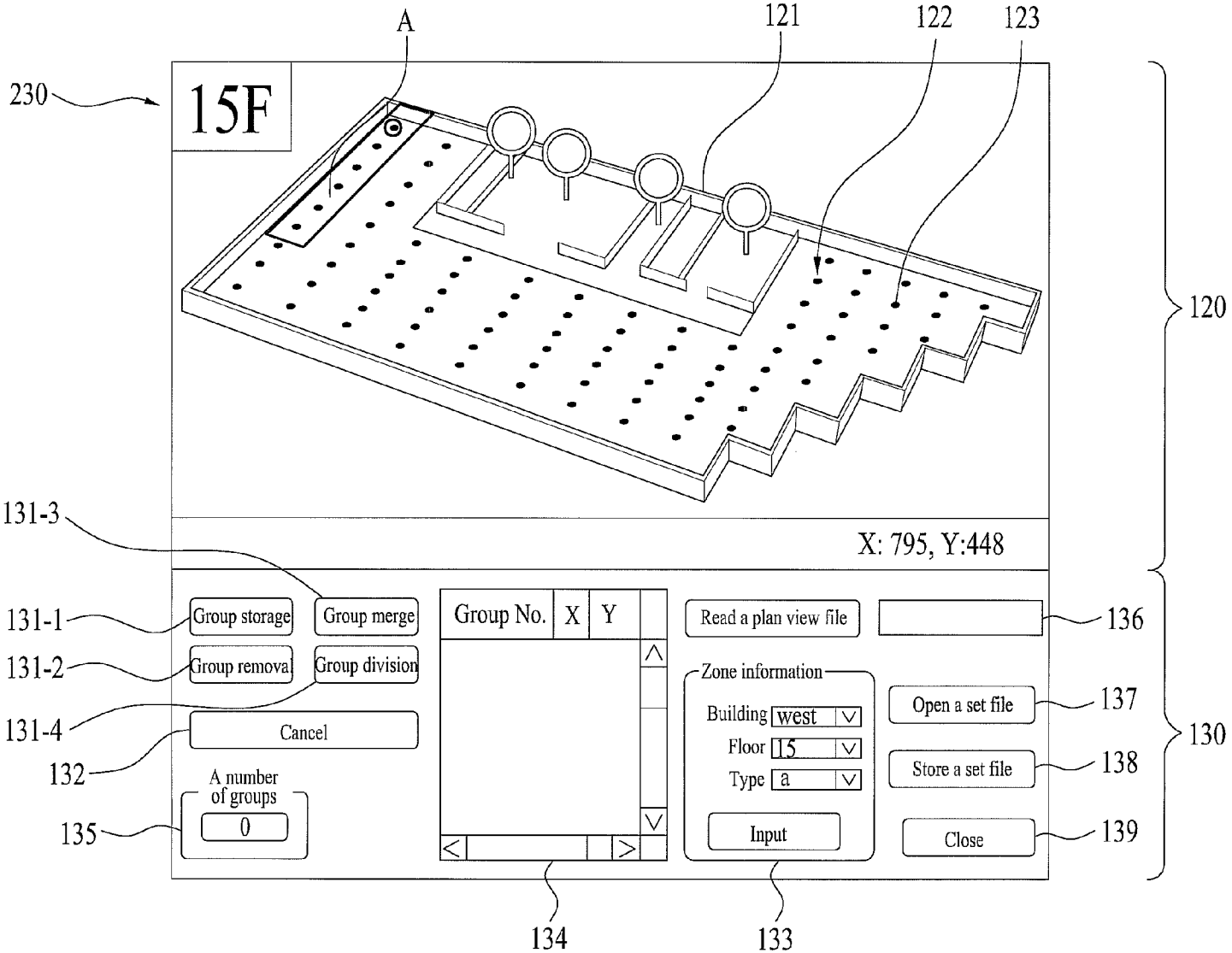

Referring to FIG. 7B, the reference coordinates 123 may be connected in succession using a mouse to define a particular zone A. The cursor or icon may be displayed over a reference coordinate dot 123 to indicate the current position. For example, a circle may be displayed around a selected reference coordinate dot 123. Moreover, another graphical indicia, such as a box as shown, may be displayed to indicate the selected group of reference coordinate dots 123. If the reference coordinates 123 are to be connected, it may be preferable that the reference coordinates 123 are connected in a particular direction, such as a clockwise direction or a counterclockwise direction. It should be appreciated, however, that any reference coordinate 123 may be selected for inclusion in a control group, irrespective of whether they are positioned adjacent to each other. For example, a control group may be set which includes select light emitting apparatuses positioned near entryways.

Upon selection of the Group storage button 131-1 after the particular lighting space A has been selected, the processor 210 may determine that the selected lighting space A is a new control group. Upon selection of button 138 ("Store a set file"), the plan view image 121 having information corresponding to the new control group may be stored.

Figure 8A:
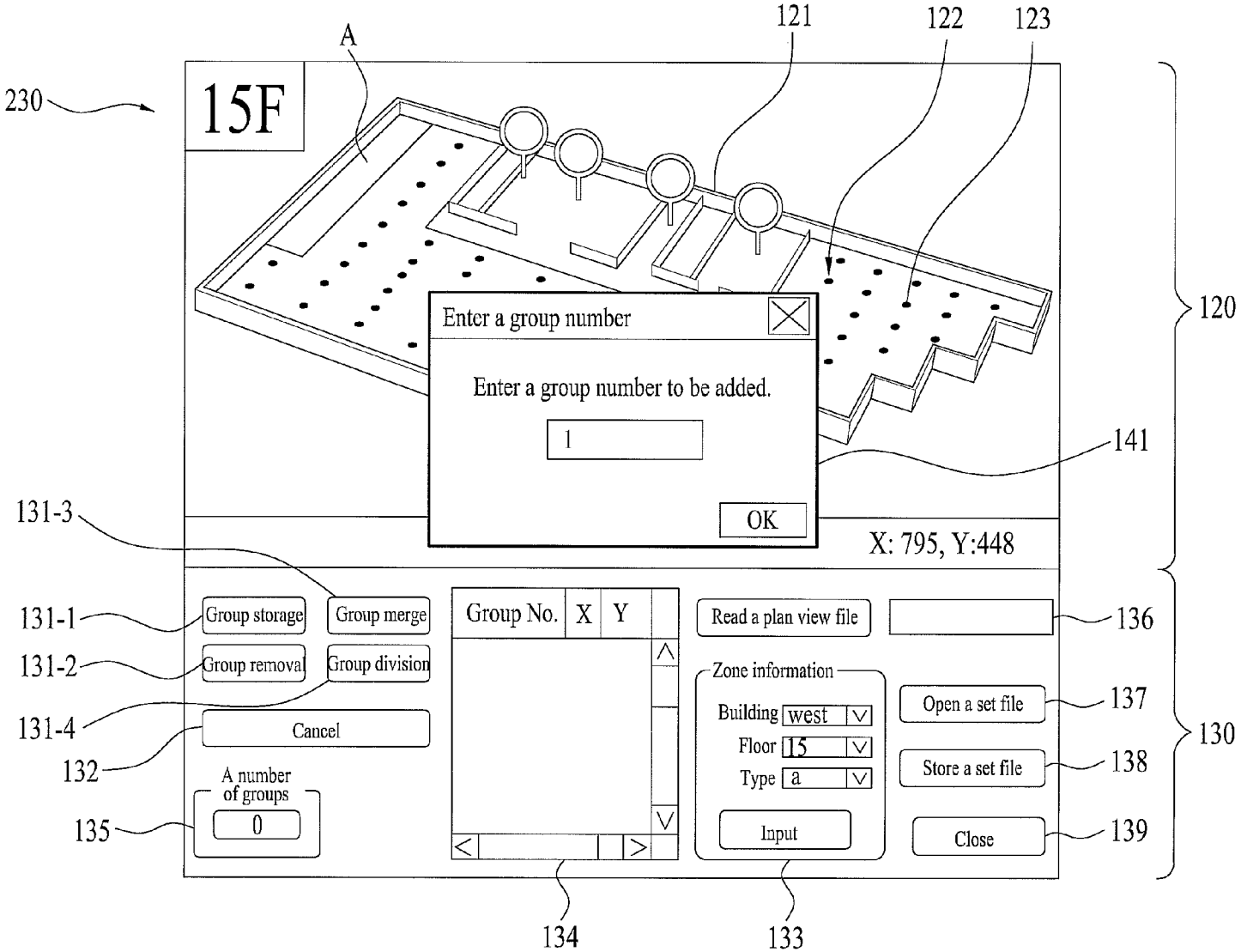
Figure 8B:
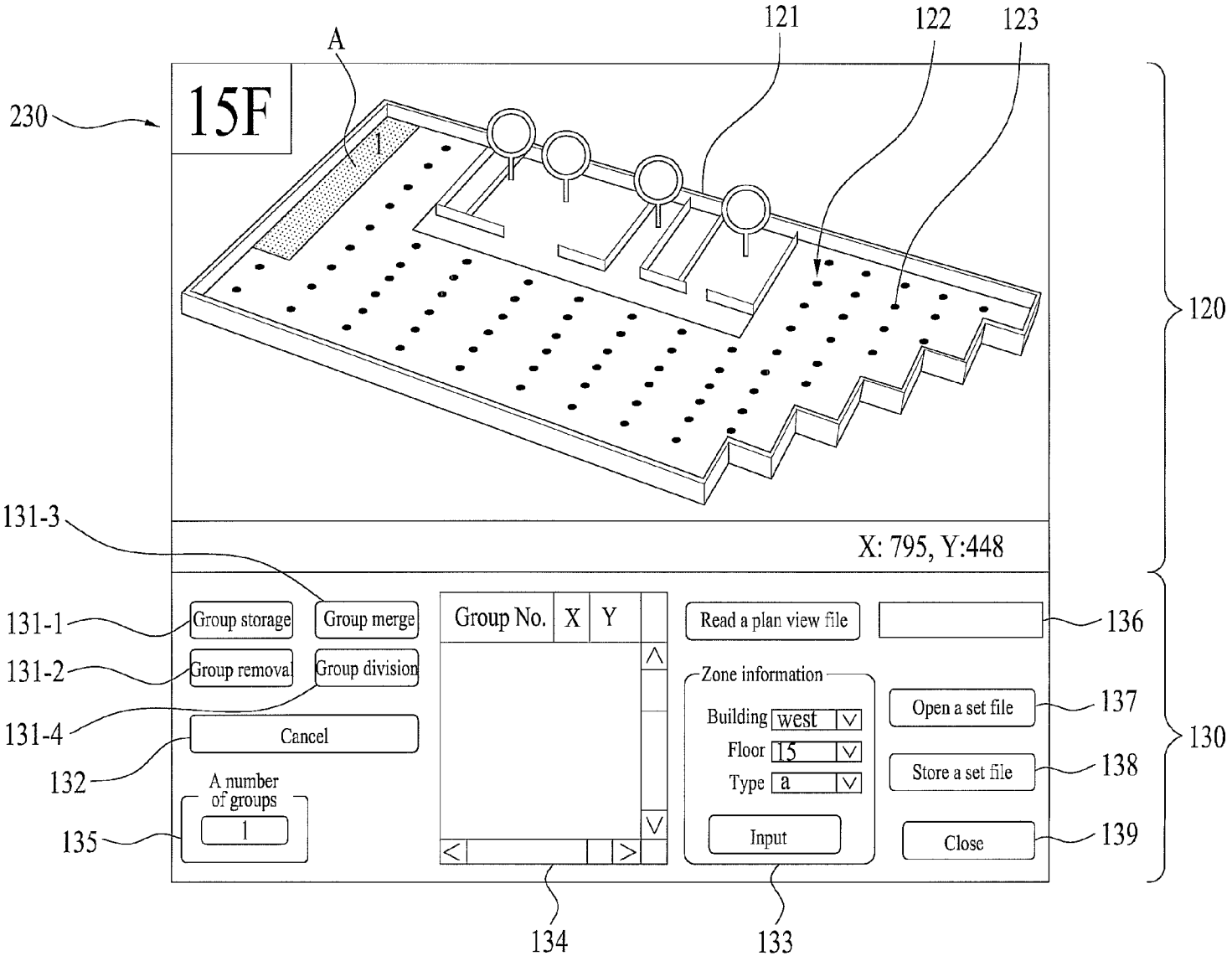

As shown in FIG. 8A, a pop-up window 141 may be displayed prompting the user to enter a group number for the new control group number. If, for example, a number "1" is entered in the pop-up window 141, the new control group including the control group number "1" may be displayed on the plan view image 121. In the meantime, the object 135 ("A number of groups") may be updated to indicate the number of groups existing at the present time, as shown in FIG. 8B.

Moreover, to delete a control group, the control group to be removed may be selected from the plan view image 121. Once the desired control group is selected, a selection of the Group removal button 131-2 may delete the selected control group. Alternatively, a selection of the Group removal button 131-2 without selecting the desired group in the plan view image 121 may cause a pop-up window to be displayed. One or more control group numbers may be entered to delete the desired control groups.

Figure 9A:
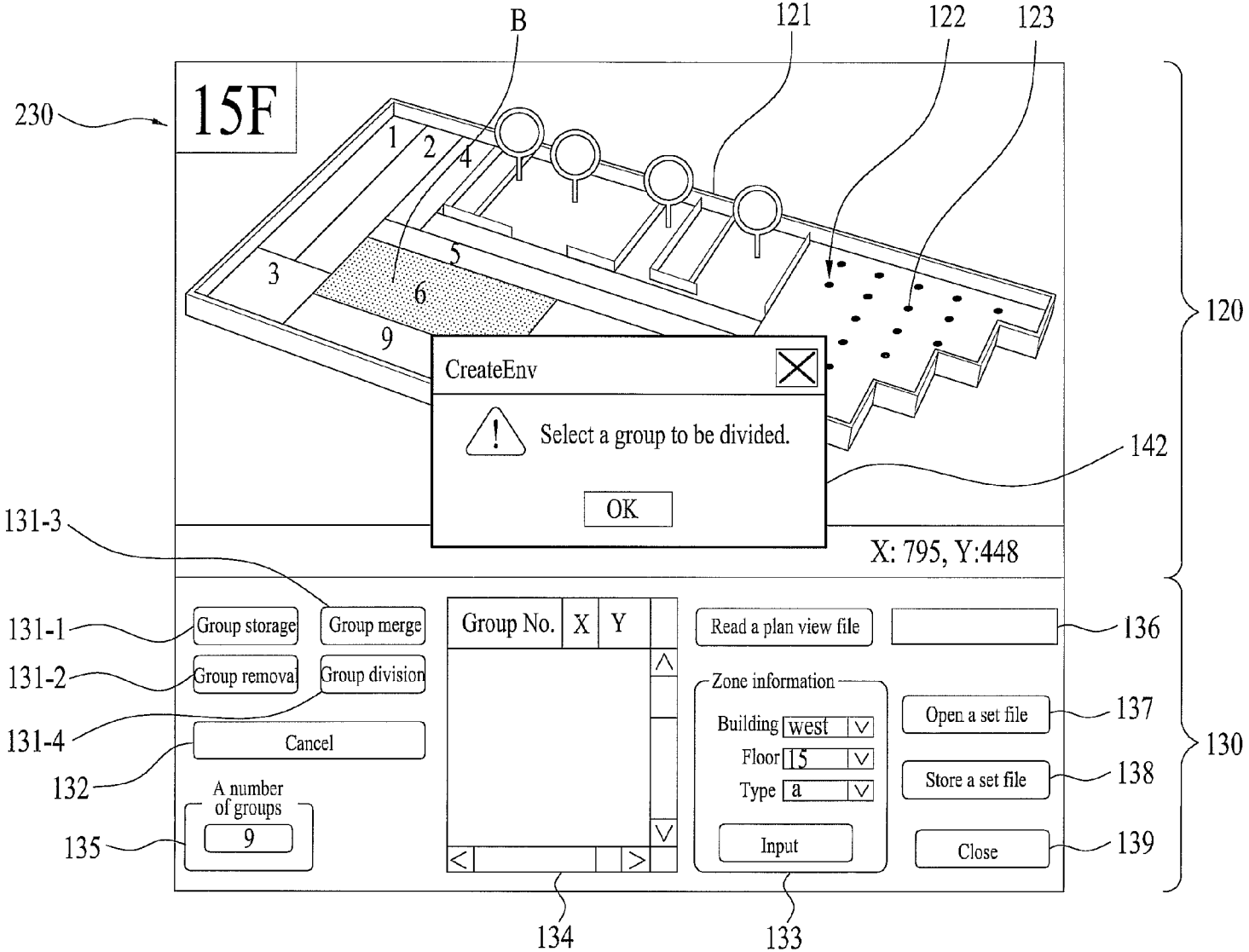
FIGS. 9A, 9B, 9C, and 9D show display images that illustrate an operation to divide a control group in a lighting apparatus in accordance with an embodiment of the present disclosure.
Figure 9B:
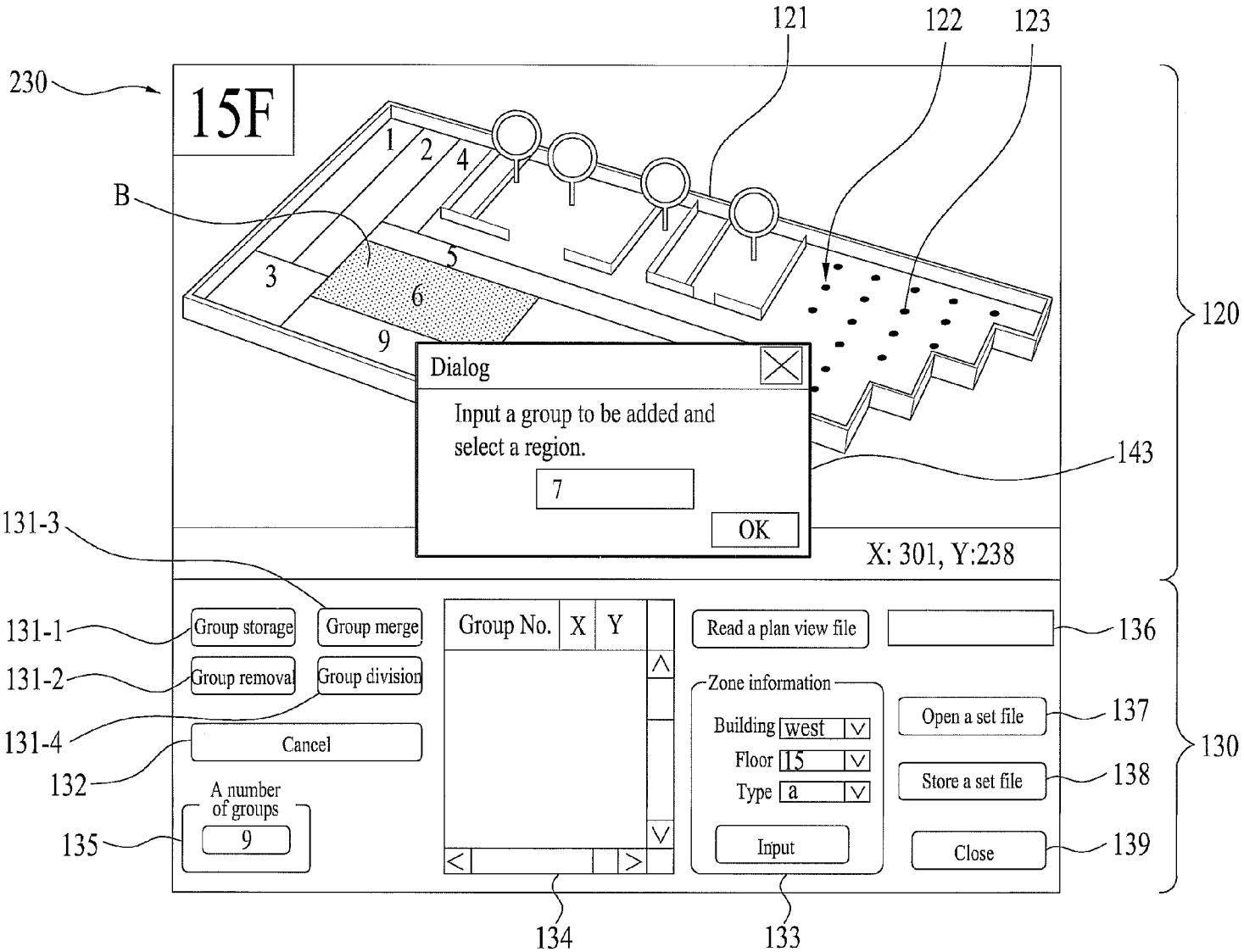

FIGS. 9A to 9D show plan views to illustrate an operation to divide a control group into at least two new control groups in accordance with an embodiment of the present disclosure. The Group division button 131-4 in the second display region 130 may be selected to divide a control group. As shown in FIG. 9A, a pop-up window 142 may be displayed instructing the user to select a control group to be divided from the plan view image 121. One or more control groups may be selected to be divided. As shown in FIG. 9B, if the sixth control group B is selected, a pop-up window 143 may be displayed prompting the user to enter a number for the new control group and to select a region corresponding to the new control group.

Figure 9C:
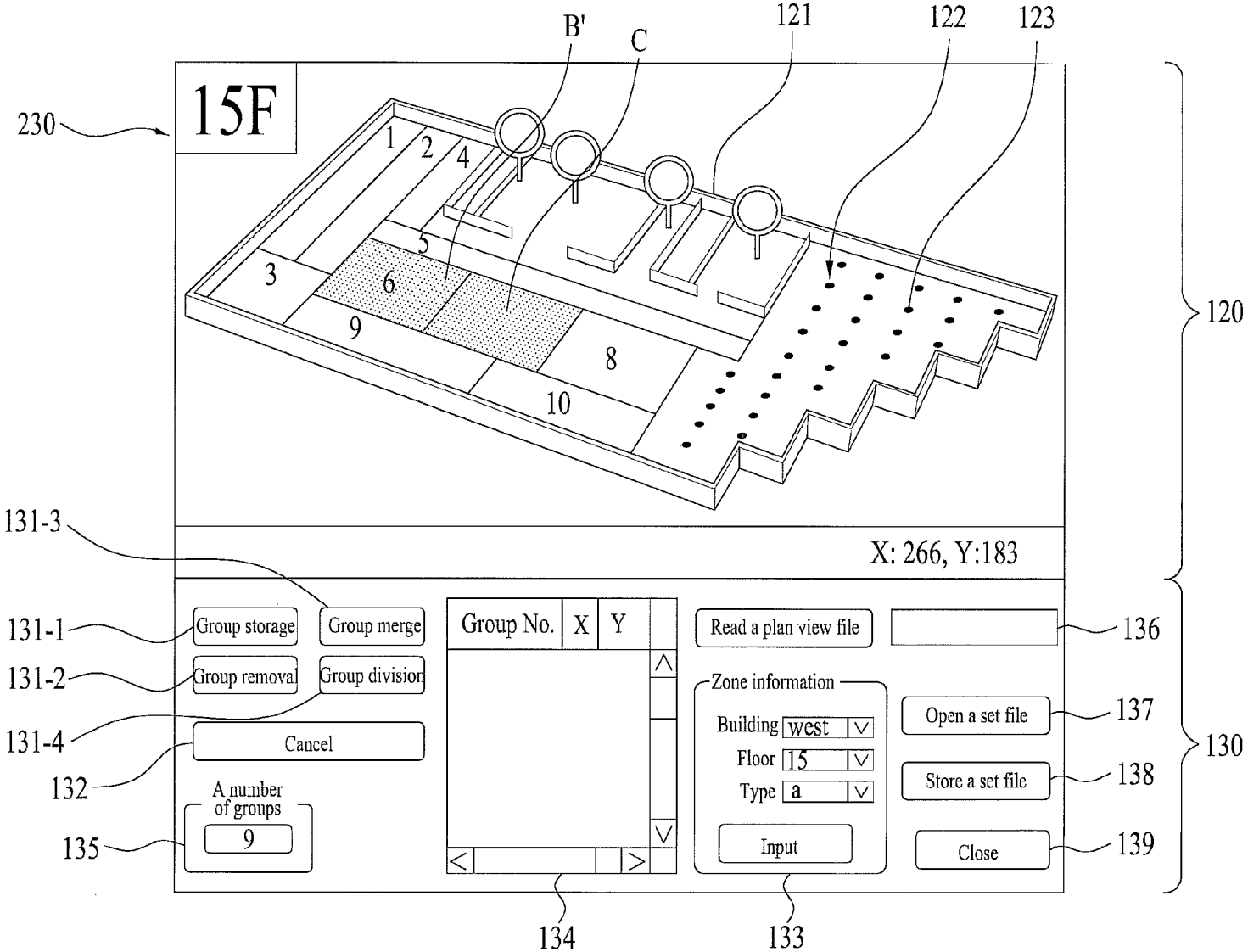
Figure 9D:
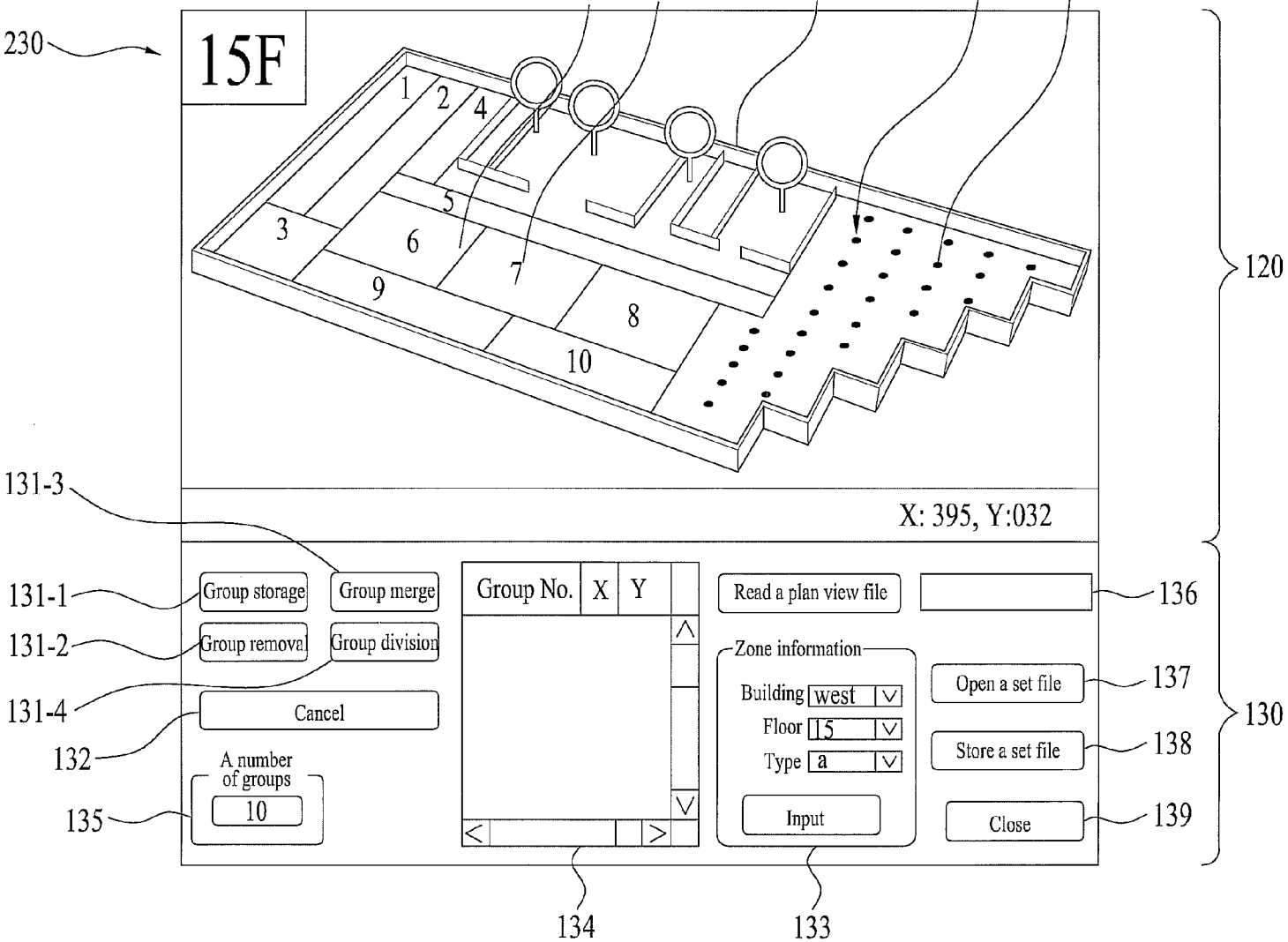

In this example, the number "7" may be entered in the pop-up window 143 as the new control group number. Region B may be selected on the plan view image 121 to divide the region into regions B' and C, as shown in FIG. 9C. Reference coordinate dots 123 may be displayed in region B to aid in the selection of the new region. The processor 210 may then divide control group 6 into two control groups 6 and 7 corresponding to regions B' and C, as shown in FIG. 9D. The indicator object 135 may be updated to reflect the new number of control groups remaining after the divide process, as shown.

Figure 10A:
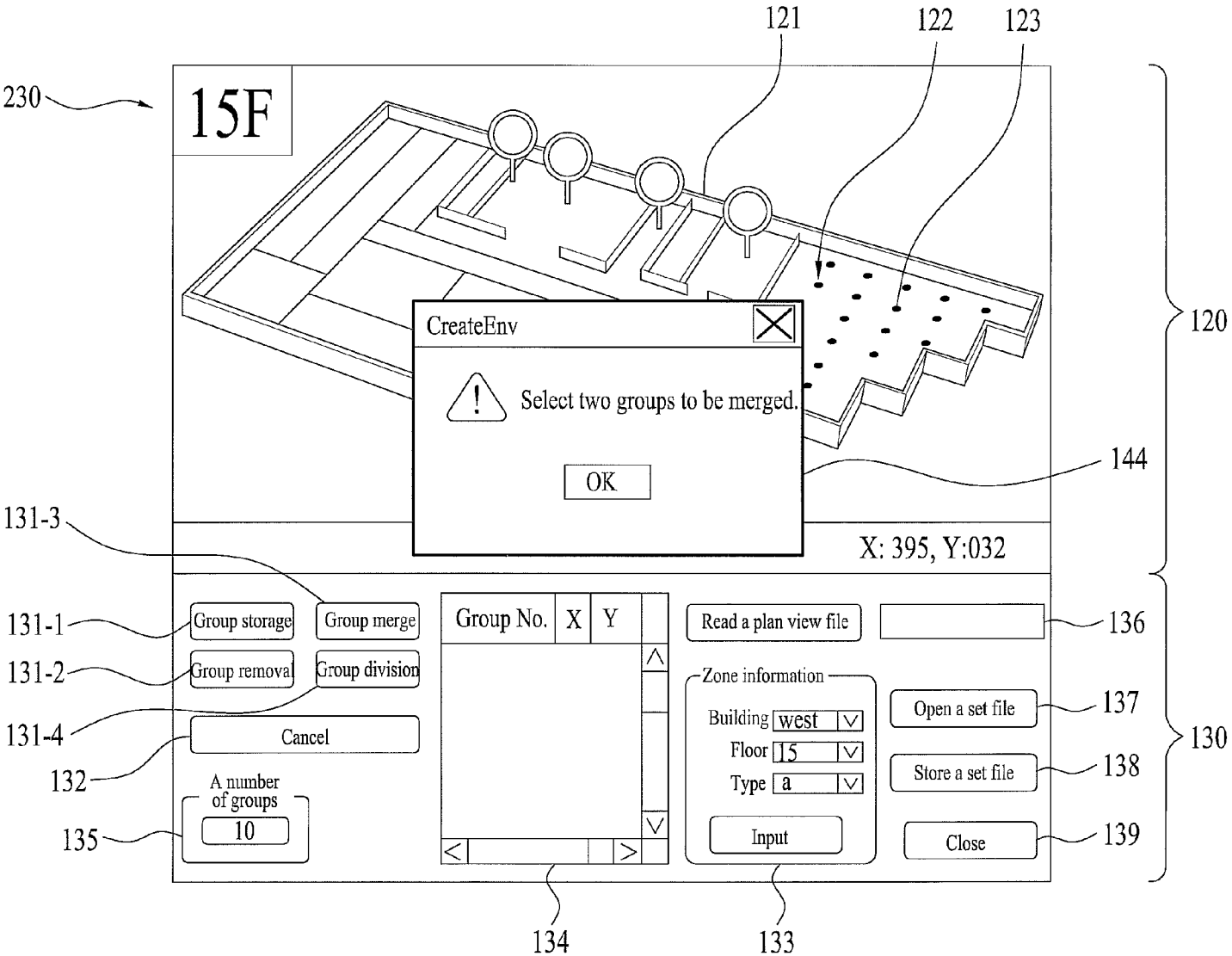
FIGS. 10A, 10B, and 10C show display images that illustrate an operation to divide at least two zones into a new control group in a lighting apparatus in accordance with an embodiment of the present disclosure.
Figure 10B:
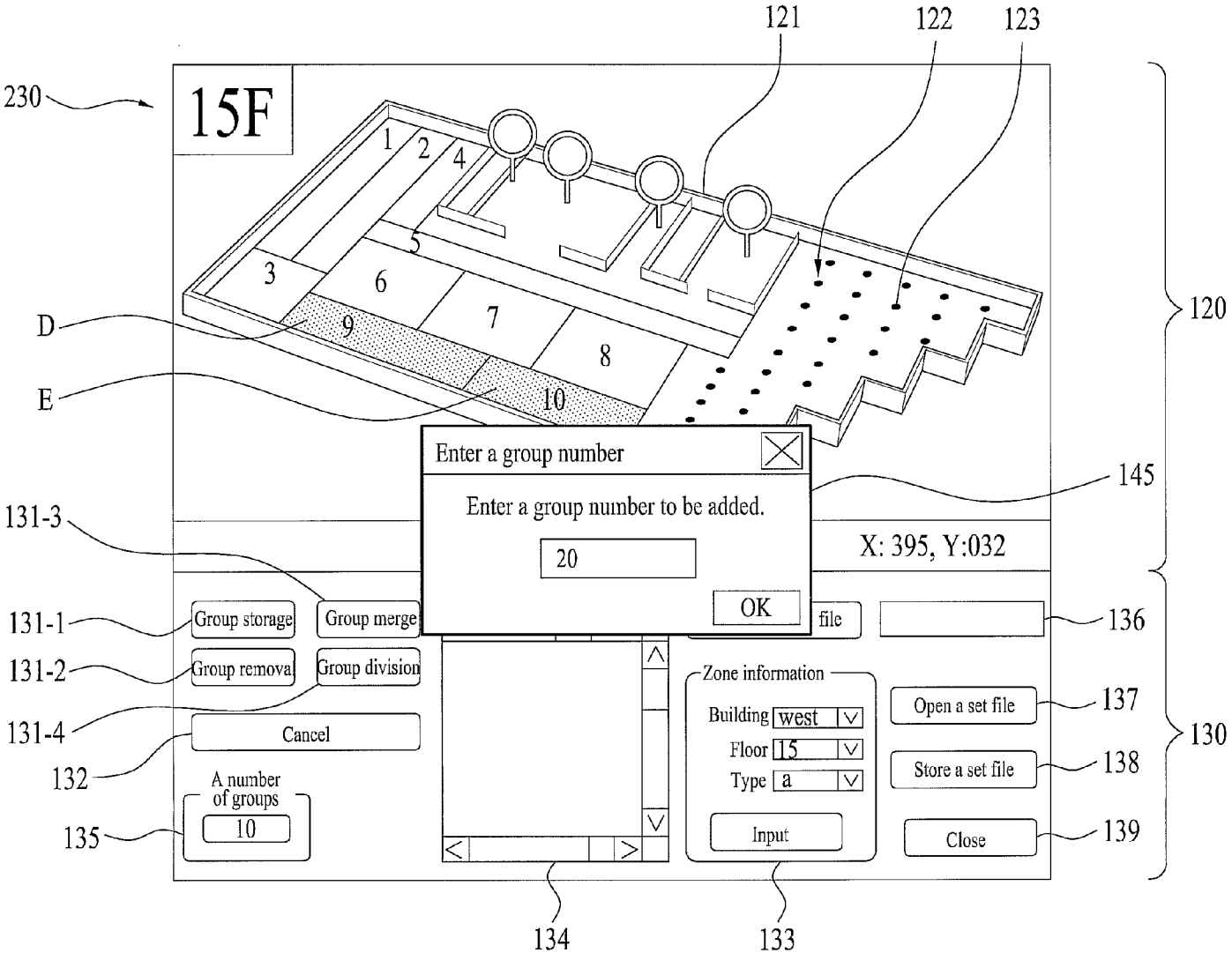
Figure 10C:
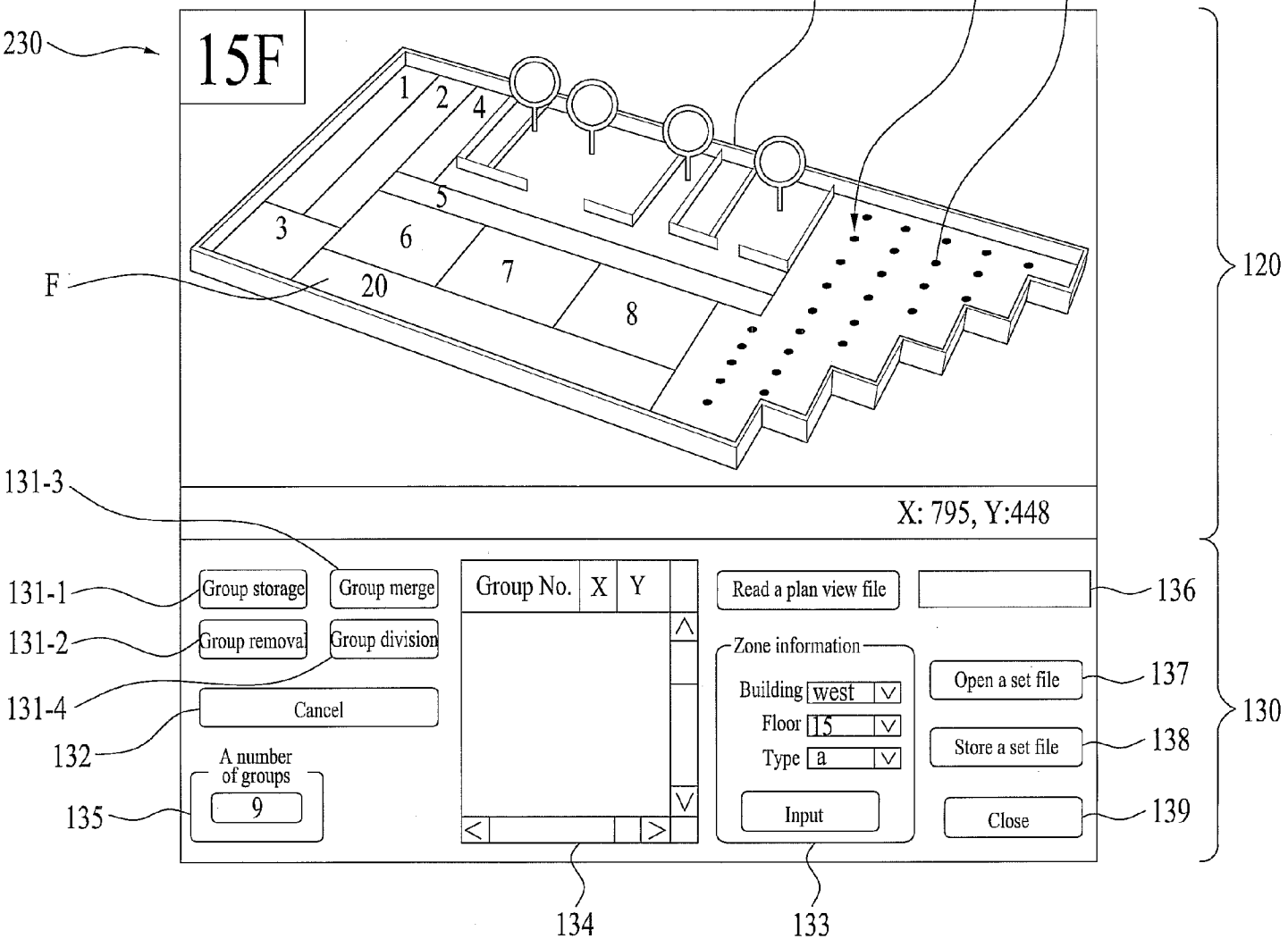

FIGS. 10A to 10C are plan views that illustrate a process of merging at least two zones into a new control group. The Group merge button 131-3 may be selected from the second display region 130. A pop-up window 144 may be displayed to prompt the user to select the control groups to be merged. As an example, if a ninth control group D and a tenth control group E are selected to be merged, a pop-up window 145 may be displayed prompting the user to enter a control group number for the new merged control group, as shown in FIG. 10B. If the number "20" is entered for the new control group, a new merged control group F may be displayed in the plan view image 121 which includes regions previously occupied by control groups D and E. The new control group F may include a label "20" identifying this control group in the plan view image 121, as shown in FIG. 10C. The indicator object 135 may be updated to reflect the number of control groups after the merge process, as shown.

To achieve the objects and other advantages in accordance with the purpose of the disclosure, as embodied and broadly described herein, a lighting control system may include a plurality of lighting apparatuses provided in a building, a display for displaying an image representing the plurality of lighting apparatuses, an input interface for selecting at least one region on the image that corresponds to one or more of the plurality of lighting apparatuses, a memory for storing the selected region of the image, and a controller configured to control the lighting apparatuses, wherein one or more control groups are configured based on the selected region and the image is updated to display the control groups.

In this embodiment, the image may include a coordinate system displayed on the image. The coordinate system may include a plurality of objects displayed at predetermined intervals in at least one of a horizontal or vertical directions on the image. A position of the plurality of lighting apparatuses in the building may correspond to a relative position of the plurality of objects in the image. An address of each of the plurality of lighting apparatuses may be associated with a corresponding object displayed in the image and stored together with the image.

In this embodiment, the control group may be configured by selecting one or more of the objects on the image. The controller may be configured to store an address for the lighting apparatuses in the control group, and simultaneously control the lighting apparatuses in the control group using the stored addresses. The controller may be configured to reconfigure a previously stored control group based on the selection of the objects on the image, and display the reconfigured control group on the image. The controller may be configured to merge two or more control groups based on the selection of the objects on the image, and display the merged control group on the image. The controller may be configured to divide a control group into two or more control groups based on the selection of the objects on the image, and display the divided control groups on the image. Moreover, the objects may be at least one of dots, lines, icons, or grid.

In one embodiment, a lighting controller may include a display having a first display region for displaying an image of a lighting space having a plurality of light emitting apparatuses mounted thereto and a second display region for displaying a plurality of input objects, and a processor configured to generate a reference coordinate system having at least one reference coordinate displayed on the image, the reference coordinate on the image corresponding to a relative position in the lighting space. The processor may configure one or more control groups for controlling the light emitting apparatuses based on a selection of the at least one reference coordinate on the image and a selection of one of the plurality of input objects.

The plurality of input objects may include a first input object for storing a control group, a second input object for deleting a control group, a third input object for merging a control group, a fourth input object for dividing a control group, and a fifth input object for selecting a particular lighting space. The plurality of input objects may be at least one of a button, drop down menu, or text field.

In this embodiment, when the first input object is selected, the processor may be configured to store an address of the lighting apparatus associated with the selected reference coordinates with the control group, and display the stored control group on the image. Moreover, when the third input object is selected, the processor may be configured to merge two or more control groups and store the merged control group as a new control group, and when the fourth input object is selected, the processor may be configured to divide a control group into two or more new control groups and store the divided control groups. Moreover, the processor may generate control group numbers for display on the image.

In one embodiment, a lighting system may include a plurality of light emitting apparatuses mounted to a lighting space, at least one bridge device connected to the plurality of light emitting apparatuses, a gateway connected to the bridge device, a central controller including a lighting controller connected to the gateway, the lighting controller having addresses of the light emitting apparatuses stored therein, and a terminal connected to the lighting controller for transmitting configuration and control information for the light emitting apparatuses to the lighting controller, and an interface connected to the lighting controller configured to receive inputs for controlling the lighting apparatuses and display an operational state of the lighting apparatuses. The terminal may include a display for displaying an image of the lighting space having the plurality of the light emitting apparatuses mounted thereto, and a processor for displaying a reference coordinate system on the image for dividing the lighting space into a plurality of control groups.

In this embodiment, the processor may be configured to update a list of addresses of the light emitting apparatuses included in each of the control groups and store the addresses with the image. Moreover, the processor may be configured to reconfigure an existing control group based on a selection of a region on the image using the reference coordinate system, update the image to include the reconfigured control group, and transmit the updated image to the interface through the lighting controller.

In one embodiment, a central controller may include a display for displaying drawing information on a lighting space having a plurality of light emitting apparatuses mounted thereto, and a controller for displaying a reference coordinate system on the drawing information on the display to divide the lighting space into a plurality of control groups with reference coordinates.

In one embodiment, a central controller may include a display having a first display region for displaying drawing information on a lighting space having a plurality of light emitting apparatuses mounted thereto, and a second display region having a plurality of input objects displayed thereon. The central controller may include a controller for displaying a reference coordinate system at the first display region of the display to divide the lighting space into a plurality of control groups with reference coordinates. The controller may be configured to set or change at least one control group according to a command inputted through the input objects.

In one embodiment, the lighting system may include a plurality of light emitting apparatuses mounted to a lighting space, at least one bridge device connected to the plurality of light emitting apparatuses to enable communication therewith, a gateway connected to the bridge device to enable communication therewith, and a central controller including a lighting controller connected to the gateway to enable communication therewith. The lighting controller may have list addresses of the light emitting apparatuses stored therein. The lighting system may include a monitoring panel connected to the lighting controller to enable communication therewith for transmitting set information and control information on the light emitting apparatuses, and an interface connected to the lighting controller to enable communication therewith for inputting a control order or displaying an operation state.

The monitoring panel may include a display having a first display region for displaying drawing information on a lighting space with a plurality of the light emitting apparatuses mounted thereto, and a second display region with a plurality of input objects displayed thereon. The monitoring panel may include a control unit for displaying a reference coordinate system at the first display region of the display unit for dividing the lighting space into a plurality of control groups by means of reference coordinates, and setting or changing at least one control group according to an input applied thereto from the input objects.

If there is a change in a configuration of the one or more of the control groups, the control unit may change the list addresses of the light emitting apparatuses to correspond to the change in the control groups. The list addresses stored in the control unit of the light emitting apparatuses may be transmitted from the lighting controller. The control unit may transmit the drawing information that includes the change in the control groups to the interface through the lighting controller.

The monitoring panel may set or change the control group on the plan view of the lighting space, and may transmit drawing information that includes the change in the lighting space to the interface through the lighting controller. The drawing information of the lighting space may be displayed on the display of the interface to provide a graphical user interface to the user.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments may be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting control system comprising:

a display configured to display floor plan of a lighting space having a plurality of light emitting units mounted thereto and display a grid for a reference coordinate system on the floor plan to divide the floor plan into a plurality of control groups using the grid on the floor plan, wherein the grid is displayed at prescribed intervals throughout the floor plan and does not have a one-to-one relationship with the light emitting units, at least a portion of the grid being displayed at a location on the floor plan without a corresponding light emitting unit;

an input interface for selecting a particular region of the floor plan displayed by selecting reference coordinates of the grid;

a memory for storing group information on an area of the floor plan fixed with the particular reference coordinates, and group information on the light emitting units mounted to the area of the floor plan; and a controller for integrating and storing the group information stored in advance, the group information on the particular region, and the group information on the light emitting units mounted to the particular region when the group information on the particular region selected is changed.

2. The lighting control system of claim 1, wherein the grid includes a plurality of points spaced at predetermined intervals in at least one of horizontal and vertical directions on a rectangular coordinate system.

3. The lighting control system of claim 2, wherein the controller activates a particular lighting space fixed by connecting the plurality of points on the grid selected by a user on the display.

4. The lighting control system of claim 3, wherein the controller stores the lighting space activated according to user's input as a new control group, or removes the lighting space from the control group and wherein the controller integrates the new control group and an existing control group, and stores the same together with the drawing information.

5. The lighting control system of claim 3, wherein if two or more than two lighting spaces are activated according to user's input, the controller merges the lighting spaces into a control group, or divides the lighting space into two control groups.

6. The lighting control system of claim 1, wherein coordinate values for a point selected on the grid is displayed adjacent to the displayed floor plan.

7. A lighting control system comprising:

a display including a first region for displaying a floor plan of a lighting space having a plurality of light emitting units mounted thereto and display a grid for a reference coordinate system on the floor plan to divide the floor plan into a plurality of control groups using the grid on the floor plan, wherein the grid is displayed at prescribed intervals throughout the floor plan and does not have a one-to-one relationship with the light emitting units, at least a portion of the grid being displayed at a location on the floor plan without a corresponding light emitting unit, and a second region having an input interface displayed thereon for selecting a particular region of the floor plan displayed by selecting reference coordinates of the grid; and a controller for storing group information on an area of the lighting space defined with the particular reference coordinates and list information on the light emitting units mounted to the portion of the lighting space, and, if control group information on the particular region selected is changed, integrating and storing control group information stored in advance, control group information on the particular region, and the list information on the light emitting units mounted to the particular region.

8. The lighting control system of claim 7, wherein the input interface includes a first input unit for storing or removing the control groups, a second input unit for merging or dividing the control groups, and a third input unit for selecting a particular lighting space.

9. The lighting control system of claim 8, wherein the controller activates the particular lighting space fixed by connecting a plurality of coordinates on the displayed grid selected by the user on the first display region.

10. The lighting control system of claim 9, wherein if the first input unit is selected, the controller stores a relevant lighting space as a new control group, or removes the relevant lighting space from the control group.

11. The lighting control system of claim 9, wherein if the second input unit is selected, the controller merges two or more than two lighting spaces activated thus as a new control group, or divides the two or more than two lighting spaces activated thus into new control groups respectively.

12. The lighting control system of claim 11, wherein the controller integrates new control groups and existing control groups and stores the same together with the drawing information.

13. The lighting control system of claim 7, wherein the controller outputs control group numbers respectively matched to the lighting spaces to the drawing information.

14. The lighting control system of claim 7, wherein coordinate values for a point selected on the grid is displayed adjacent to the displayed floor plan.

15. A lighting system comprising:

a plurality of light emitting units mounted to a lighting space;

at least one bridge device connected to the plurality of light emitting units to enable communication therewith;

a gateway connected to the bridge device to enable communication therewith;

a central controller including a lighting controller connected to the gateway to enable communication therewith, and having a list of addresses of the light emitting units stored therein, and a monitoring panel connected to the lighting controller to enable communication therewith for transmission of setting information and control information on the light emitting units to the lighting controller; and an interface connected to the lighting controller to enable communication therewith for application of a control order or displaying an operation state, wherein the monitoring panel includes;

a display including, a first region for displaying a floor plan of a lighting space having a plurality of light emitting units mounted thereto and display a grid for a reference coordinate system on the floor plan to divide the floor plan into a plurality of control groups using the grid on the floor plan, wherein the grid is displayed at prescribed intervals throughout the floor plan and does not have a one-to-one relationship with the light emitting units, at least a portion of the grid being displayed at a location on the floor plan without a corresponding light emitting unit, and a second region having an input unit displayed thereon for selecting a particular region of the image displayed by selecting reference coordinates of the grid, and a controller for storing group information on an area of the lighting space fixed with the particular reference coordinates and list information on the light emitting units mounted to the portion of the lighting space, and, if control group information on the particular region selected is changed, integrating and storing the control group information stored in advance, the control group information on the particular region, and the list information on the light emitting units mounted to the particular region.

16. The lighting system of claim 15, wherein the controller integrates new control groups and existing control groups, and stores the same together with the drawing information.

17. The lighting system of claim 15, wherein if there is a change of the control group, the controller can change the list of addresses of the light emitting units mounted to the lighting space together with the change.

18. The lighting system of claim 17, wherein the controller receives the list of addresses of the light emitting units from the lighting controller.

19. The lighting system of claim 16, wherein the controller transmits the drawing information having the control group changed thus to the interface through the lighting controller.

20. The lighting system of claim 15, wherein coordinate values for a point selected on the grid is displayed adjacent to the displayed floor plan.

* * * * *